US005937689A

United States Patent [19]

Fabris

[11] Patent Number: 5,937,689

[45] Date of Patent: Aug. 17, 1999

[54] TRIPLE ROLLER ENTRY GUIDE

[76] Inventor: Mario Fabris, 188 N. Service Rd., Grimsby, Canada, L3M 4E8

[21] Appl. No.: 08/967,170

[22] Filed: Nov. 10, 1997

[51] Int. Cl.[6] ..... B21B 39/20

[52] U.S. Cl. ..... 72/250; 226/177

[58] Field of Search ..... 72/250, 227; 226/174, 226/177, 189, 186, 181, 187; 254/396; 242/615.3

[56] References Cited

U.S. PATENT DOCUMENTS

| | | | |
|---|---|---|---|
| 3,014,628 | 12/1961 | Littlehale | 226/177 |
| 3,765,214 | 10/1973 | Boehmer | 72/250 |
| 4,700,875 | 10/1987 | Fabris | 226/189 |
| 4,790,164 | 12/1988 | Rothe | 226/177 |

*Primary Examiner*—Joseph J. Hail, III
*Assistant Examiner*—Rodney Butler
*Attorney, Agent, or Firm*—Edward H Oldham

[57] ABSTRACT

An entry guide device comprising a funnel shaped inlet member in close proximity to three adjustable rollers mounted at 120° around the axis of work moving through the entry guide device. The adjustable rollers are actuated to move in concert so as to be able to accommodate a work product of difference diameters, whilst preserving the concentricity of the three rollers. The funnel shaped inlet member is replaceable to accommodate for wear and provision is made to calibrate the position of the three movable rollers with a calibration device which may be conveniently inserted into the device to check and calibrate the three rollers for concentricity. This entry guide device is ideally suited for guiding a work produce having circular, triangular or hexagonal cross-sections.

10 Claims, 4 Drawing Sheets

FIG.1.
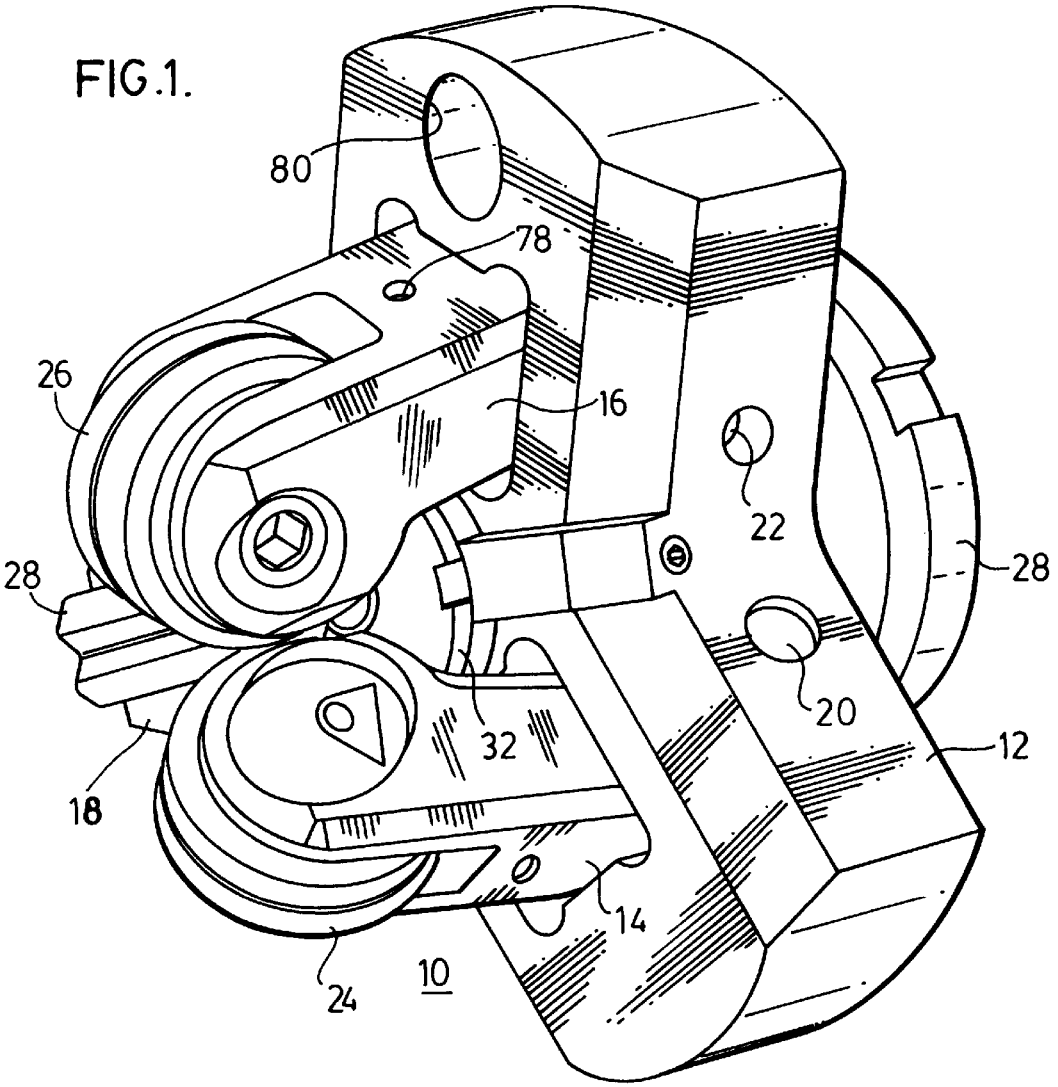
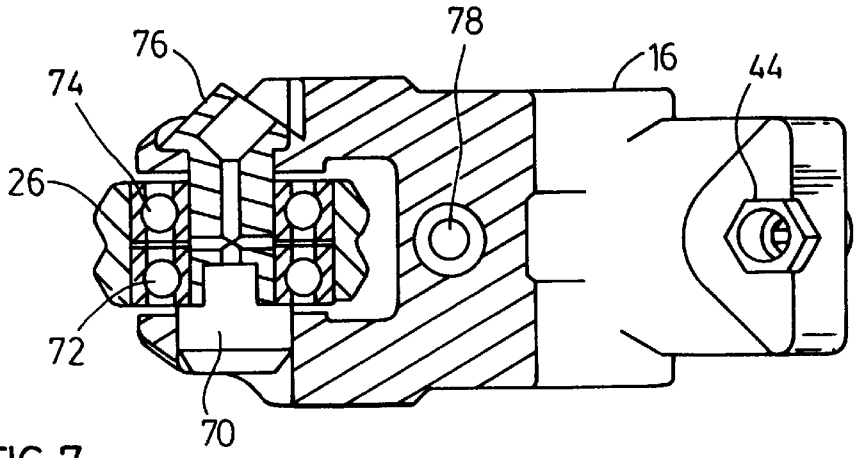
FIG.7.

TRIPLE ROLLER ENTRY GUIDE

BACKGROUND OF THE INVENTION

Roller entry guides are used in rod mills to guide a work product accurately into a set of work rolls where the work is to be altered in cross-sectional shape. Usually, a guide employing two opposed rollers is used to guide the work product into the work rollers but with the present trend to faster throughput in a modern mill and increased emphasis on quality, it may be found that roller guides having only two opposed rollers are not capable of providing the required accuracy in guiding a work product to the work rolls. Additionally when rolling materials which are of triangular or hexagonal cross-section, it may be found that entry guides having two opposed rollers may not provide the proper guiding function to achieve a quality finished product.

DESCRIPTION OF THE PRIOR ART

U.S. Pat. No. 4,680,953 to Fabris shows a dual roller entry guide having shaped rollers which are adjustably mounted in the housing so as to be movable during passage of a work product therethrough.

U.S. Pat. No. 4,373,367 to Fabris shows a double roller entry guide having a funnel shaped entrance.

U.S. Pat. No. 4,295,356 to Fabris shows a double roller entry guide having a funnel shaped entrance.

Roller entry guides are used in rod and bar mills to guide the rod to the next stand of the mill. The inlet to the entry guide is usually funnel shaped in order to guide the work product into the bite between the opposed rollers. The rollers provide accurate placement and orientation of the rod to the work rolls.

The initial setting of the rollers in the entry guide is usually made to a setting which corresponds to the nominal diameter of the rod that will be passing between them. It is usual for the diameter of the rod passing between the rolls to have substantial variations in shape and size to cause premature wear on the rolls. This can lead to frequent stoppage of the complete mill (which may contain several rolling stages) for adjustment and maintenance.

Adjustment of the spacing between the rollers has always been provided and with modem dual roller guides some provision is usually made to allow for adjustment of the roller spacing while the work is passing therethrough (see U.S. Pat. No. 4,680,953).

Certain types of rolling mills require a triple roll entry guide for proper functioning of the mill. The guide of this invention will fulfill the needs of these special types of rolling mills.

SUMMARY OF THE INVENTION

The present invention supplies a triple roller entry guide in which the spacing of the three rollers in the guide may be simultaneously adjusted in such a manner that the concentricity of the roller's bite is preserved during any adjustment of the three rollers position. Provision is also made to recalibrate the position of the rollers of the guide by providing for adjustment of the position of each individual rollers of the guide when required.

The guide has a body in which three lever arms are pivotally mounted at 120° intervals on the body. Each lever arm is spring loaded to urge the lever arm against an adjustment cone which moves laterally along the axis of the guide to cause the three rollers to simultaneously move in and out from the axis along which the rod travels.

The guide has a locking ring to lock the movable cone in a locked position. Each lever arm is provided with a set screw type adjusting device which permits individual adjustment of each lever arm with respect to the mating surface of the cone.

The guide also features a replaceable tapered inlet chute which is easily removed from the guide when the chute is worn or damaged. At the same time, a calibration standard may be inserted into the guide in the place of the tapered chute to allow the position of the individual rollers to be set to assure concentricity in the final roller adjustment.

BRIEF DESCRIPTION OF THE DRAWINGS

FIG. 1 is a perspective view of the triple roller entry guide of this invention;

FIG. 7 is a partial sectional view of a lever-roller assembly of the guide.

DESCRIPTION OF THE PREFERRED EMBODIMENT

Figure 2:
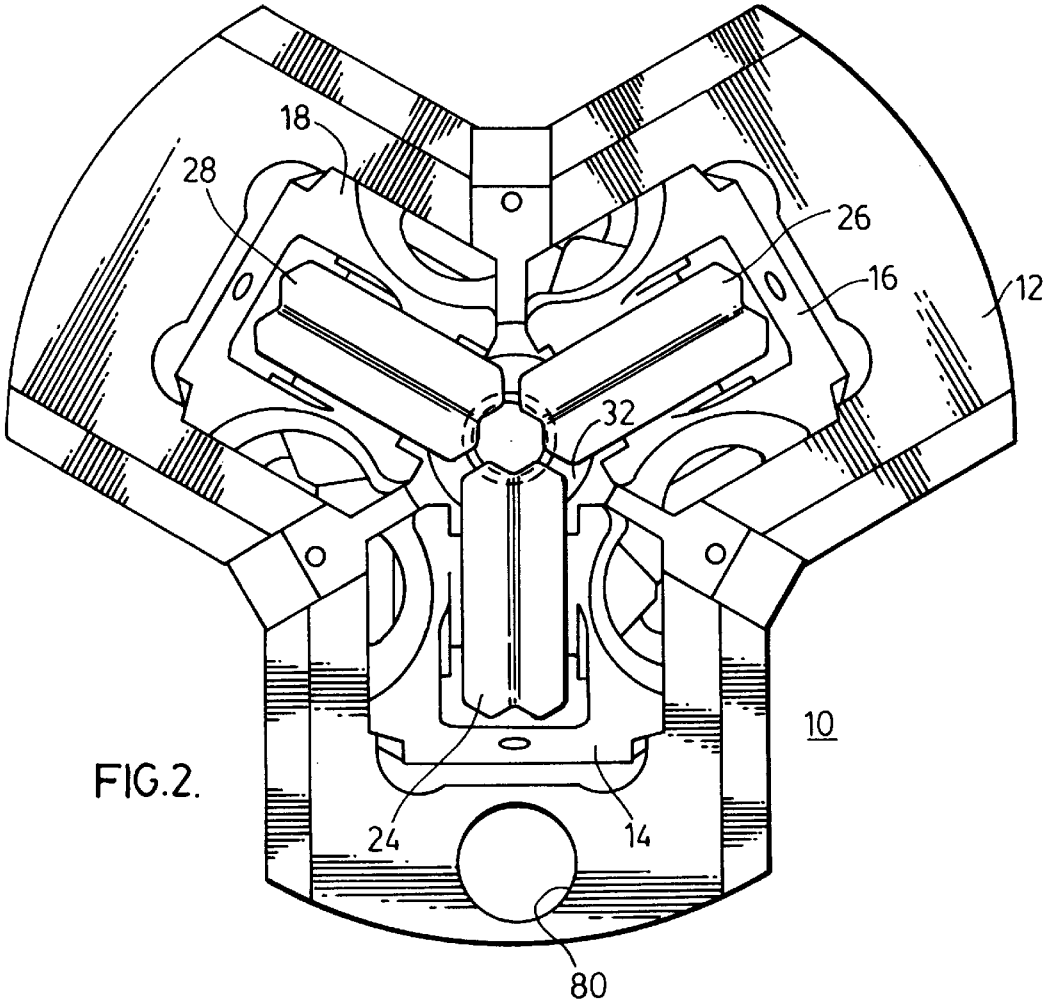
FIG. 2 is an axial view of the guide looking at the exit end of the guide.

FIG. 1 shows a triple roller entry guide 10 having a body 12 for which is mounted on a rolling stand of a rod mill., Three lever arms 14, 16 and 18 are shown on pivots of which 20 and 22 are shown.

Lever arms 14, 16 and 18 which are more fully shown in FIG. 7 have rollers 24, 26 and 28 mounted at the ends thereof to engage a work product passing through the interior of body 10. An adjusting ring 54 is shown for locating lever arms 14, 16 and 18 at the desired working position.

Figure 3:
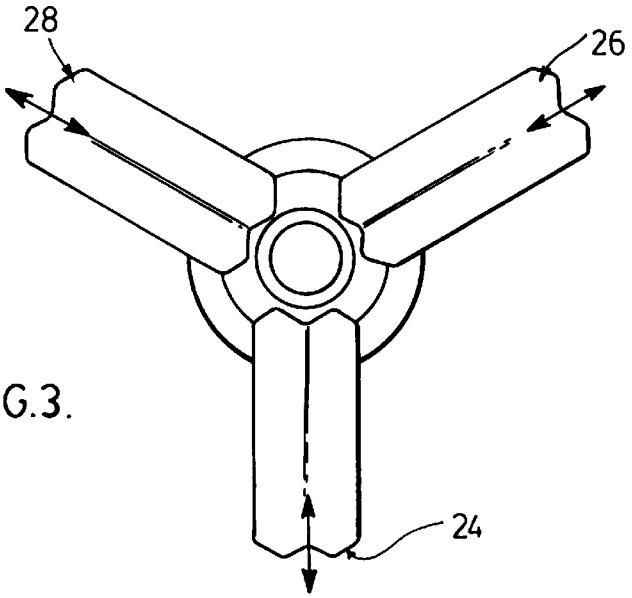
FIG. 3 is an illustration of the positioning of the rollers of the guide shown in FIG. 2.

FIGS. 2 and 3 show the alignment of rollers 24, 26 and 28 looking toward the exit end of the guide. The rollers are confined to movement in a radial direction only because of the pivot placement in body 10.

Figure 4:
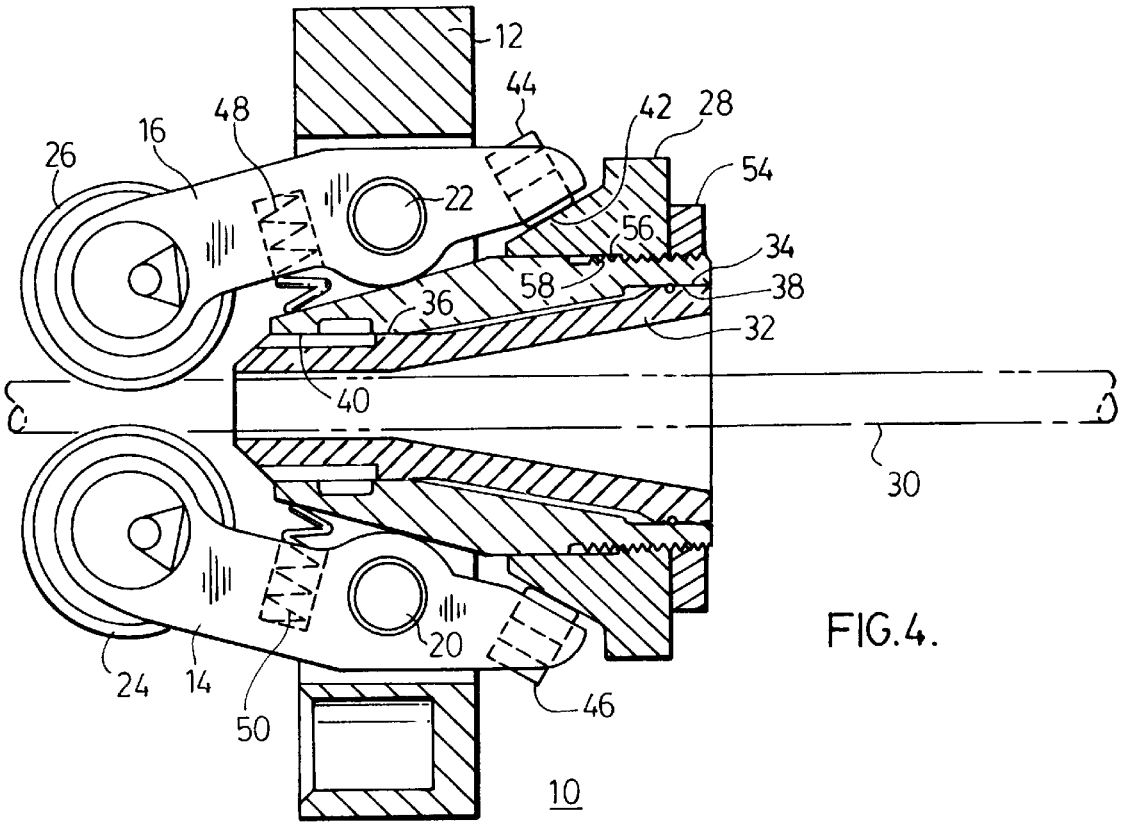
FIG. 4 is an illustration of the guide showing the position of two of the lever-roller assemblies.
Figure 5:
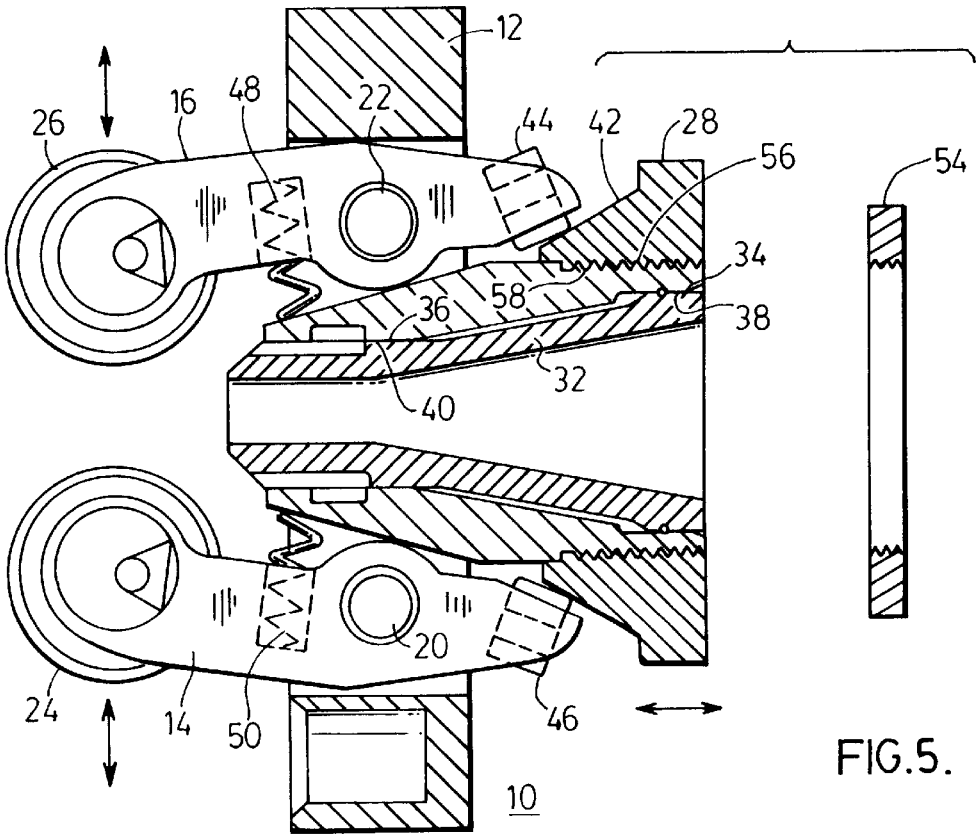
FIG. 5 is an illustration of the adjustable feature of the rollers of the guide.

Referring to FIG. 4 where a rod 30 shown passing through the entry guide, it will be seen that body 10 houses an insert 32 which fits into body 10 in a sliding fit. Insert 32 is a tapered inlet chute. Surfaces 34 and 36 of body 12 mate with surfaces 38 and 40 of insert 32.

Ring 54 is integrally attached to cone 42 which is in engagement with set screws 44 and 46 of lever arms 16 and 14 respectively. Springs 48 and 50 serve to ensure that the lever arms are biased in such a manner as to keep set screws 44 and 46 in contact with cone 42.

Cone 42 has a threaded bore 56 and is adjusted by twisting ring 54 so that the position of the cone may be moved laterally back and forth on the mating threads 58 of body 10 to open and close the roller gaps. Locking ring 54 serves to lock cone ring in its final position.

Figure 6:
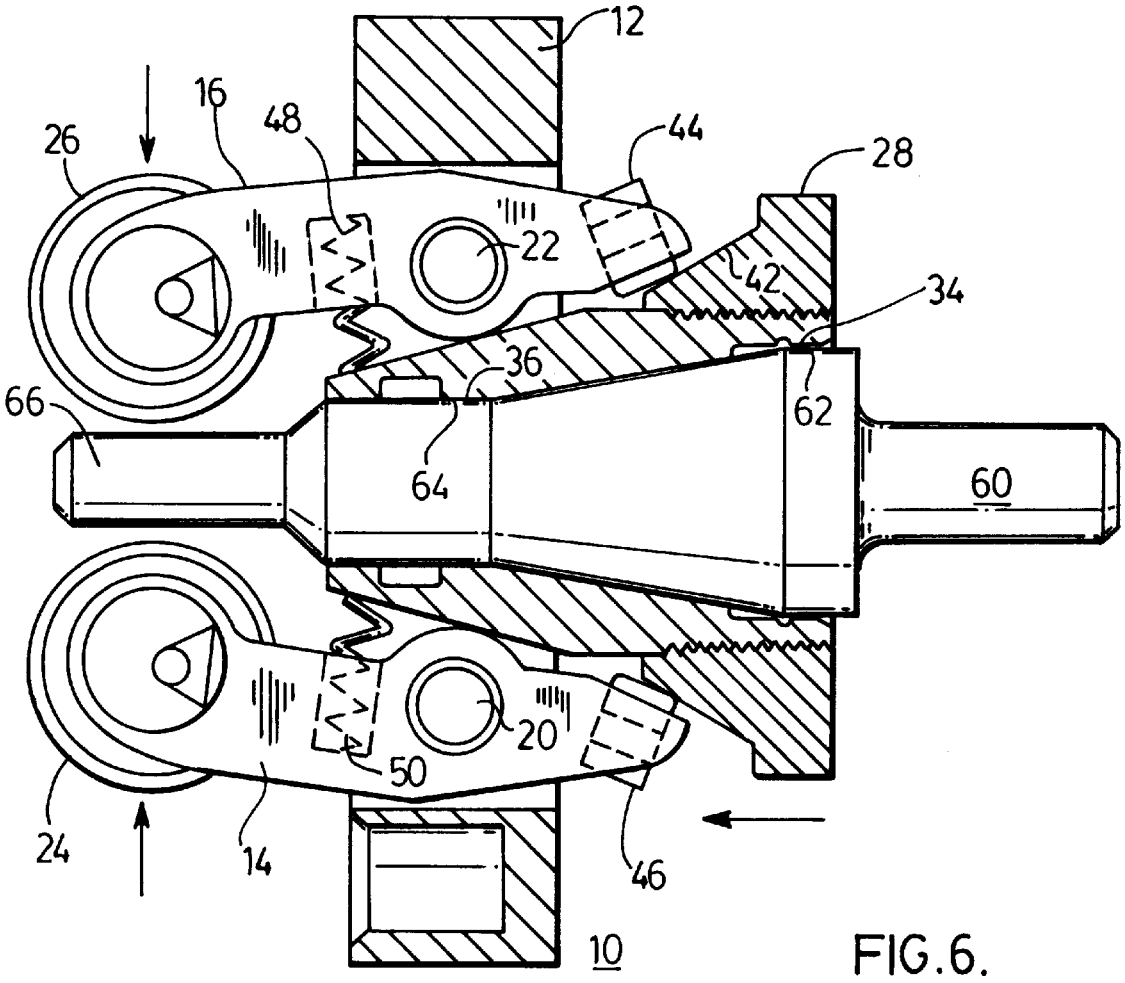
FIG. 6 is a partial sectional view showing the use of a calibration standard.

Referring to FIG. 6, a calibration device 60 is shown in body 12 in place of tapered inlet chute insert 32. Insert 32 is removed from body 12 and calibration standard 60 is inserted therefor.

Standard 60 has mating surfaces 62 and 64 which mate with surfaces 34 and 36 so as to accurately position the cylindrical nose 66 concentric with the central axis of the entry guide 10.

To calibrate the roller positions cone 42 is advanced toward the lever arms 14, 16 and 18 until one of the rollers 24, 26 and 28 contacts nose 66 of standard 60. The set screw such as 44 is relaxed until another one of the rollers touches the nose 66. At this time, it is possible to continue relaxing the set screws in the two arms whose rollers have previously engaged nose 66, or alternatively the set screw in the lever arm of the roller which has not engaged the nose 66 may be advanced until its corresponding roller engages nose 66.

At this time, the three lever arm set screws are locked to preserve the concentricity of the surfaces of rollers 24, 26 and 28. Cone 42 is now adjusted to provide the final position of arms 14, 16 and 18 and when the desired position is reached, locking ring 54 locks cone 42 in place.

FIG. 7 shows a detail drawing of lever arm 16. Wheel 26 is mounted on a pair of bearings 72 and 74. Members 70 and 76 form a pivot for the bearings 72 and 74. The bearings 72 and 74 are standard bearings and roller wheels are standard guide rollers well known by those skilled in the art.

The advantages of the three roller entry guide are as follows:

The presence of the third roller assists in accurate placement of the work rod as it passes through the guide. Reduced wear on the rollers may result because the profile of the rollers may be modified somewhat when compared to the profile of the rollers on a two roller guide.

At times it is necessary to guide hexagonal and triangular shaped rods through a mill and this entry guide device provides the precision required for accurate rolling of these products. Of course, this entry guide provides superior performance when used with round work products.

The position of the guide rollers may be adjusted while a product is passing through the entry guide to accommodate stock having variations in size. The ability to adjust roller position whilst a rolling operation is being carried out improves mill efficiency and avoids needless down time.

While the invention has been described in detail herein in accord with certain preferred embodiments thereof, many modifications and changes therein may be affected by those skilled in the art. Accordingly, it is intended by the appended claims to cover all such modifications and changes which fall within the true spirit and scope of the invention.

I claim:

1. A roller entry guide to guide material along a longitudinal axis, said guide comprising:

a hollow housing having multiple pivot means incorporated therein for pivotally mounting at least three roller assemblies thereon at equally spaced angles about said longitudinal axis, said pivot means being located in a common plane transverse to said longitudinal axis, a roller assembly mounted on each pivot means comprising a lever having a roller mounted in a first end of said lever and an adjustment means mounted at the second end of said lever, mounting means associated with each lever for mounting each lever on each pivot means of said housing at a point intermediate said first and second ends, motion inducing means mounted on said housing for forcibly causing said roller assemblies to pivot in concert in a radial direction to move said rollers inwardly toward said longitudinal axis of said housing.

2. A roller entry guide as claimed in claim 1 wherein each lever is supplied with a bias means which urges each lever in a direction to move each roller away from said longitudinal axis.

3. A roller guide as claimed in claim 2 wherein said adjustment means is provided to move individual levers independently of the remaining levers.

4. A roller entry guide as claimed in claim 3 which has a replaceable funnel shaped guide insert fitted into said hollow housing to be concentric with said longitudinal axis.

5. A roller entry guide as claimed in claim 4 in which a calibration device is fitted into said hollow cavity to provide a cylindraceous surface adjacent to said rollers, said cylindraceous surface being concentric with said longitudinal axis.

6. A roller entry guide as claimed in claim 5 wherein each adjustment means is separately actuated to move each jaw member individually to calibrate said guide.

7. A roller entry guide for a guiding a steel rod along a longitudinal axis comprising:

a hollow metallic housing having a funnel shaped cavity extending therethrough along said axis, said funnel shaped cavity being substantially co-axial with said longitudinal axis so as to define an entrance aperture and a substantially smaller exit aperture, said housing having threaded boss means surrounding said entrance aperture, cone means threaded on said threaded boss means and being rotatable to move axially along said longitudinal axis, three pivoting lever members each having a roller mounted in one end thereof, mounted at 120° spaced intervals about said longitudinal axis on said housing so that the three rollers carried by said levers have a common confluence at a point adjacent to and spaced from said exit aperture, each lever also having a set screw adjusting means at each end opposite said roller for engagement with said cone means, to move said rollers inwardly toward said longitudinal axis.

8. A roller entry guide as claimed in claim 7 wherein bias means is provided for said lever members to urge said levers in a direction to cause said rollers to move away from said longitudinal axis.

9. A roller entry guide as claimed in claim 8 wherein a locking means is provided to lock said cone means in a predetermined location.

10. A roller entry guide as claimed in claim 9 wherein a calibration device is fitted to said housing, said device having a cylindraceous protrusion protruding from said exit aperture of said roller entry guide which is engagable by said rollers.

* * * * *